US005738273A

United States Patent [19]

Auclair

[11] Patent Number: 5,738,273

[45] Date of Patent: Apr. 14, 1998

[54] CARTON FOR BEVERAGE CONTAINERS WITH STRAP TYPE CARRYING HANDLE

[75] Inventor: Jean-Michel Auclair, Chateauroux, France

[73] Assignee: The Mead Corporation, Dayton, Ohio

[21] Appl. No.: 765,879

[22] PCT Filed: Jul. 7, 1995

[86] PCT No.: PCT/US95/09430

§ 371 Date: Jan. 7, 1997

§ 102(e) Date: Jan. 7, 1997

[87] PCT Pub. No.: WO96/01770

PCT Pub. Date: Jan. 25, 1996

[30] Foreign Application Priority Data

Jul. 8, 1994 [GB] United Kingdom ..... 9413862

[51] Int. Cl.[6] ..... B65O 5/462

[52] U.S. Cl. ..... 229/117.13; 229/103.2; 229/117.22

[58] Field of Search ..... 229/103.2, 117.13, 229/117.22; 206/427

[56] References Cited

U.S. PATENT DOCUMENTS

| | | | |
|---|---|---|---|
| 2,164,561 | 7/1939 | Berke | 229/117.13 |
| 2,482,399 | 9/1949 | Bullock | 229/117.13 |
| 2,645,407 | 7/1953 | Bergstein . | |
| 2,868,433 | 1/1959 | Anderson, Jr. | 229/117.13 |
| 2,889,104 | 6/1959 | Caster et al. . | |
| 2,955,739 | 10/1960 | Collura . | |
| 4,378,905 | 4/1983 | Roccaforte . | |
| 5,221,042 | 6/1993 | Oliff | 229/117.13 |
| 5,297,725 | 3/1994 | Sutherland | 229/117.13 |

FOREIGN PATENT DOCUMENTS

| | | |
|---|---|---|
| 0 098903 | 1/1984 | European Pat. Off. . |
| 20 52 618 | 5/1971 | Germany . |
| 873 258 | 7/1961 | United Kingdom . |
| 2 206 564 | 1/1989 | United Kingdom . |
| 2 234 495 | 2/1991 | United Kingdom . |
| 2 252 958 | 8/1992 | United Kingdom . |
| 93/15971 | 8/1993 | WIPO . |

*Primary Examiner*—Gary E. Elkins
*Attorney, Agent, or Firm*—Tsugihiko Suzuki

[57] ABSTRACT

A carton for beverage containers includes a series of hinged panels forming a sleeve and end closure panels hinged at least to one of the hinged panels for closing, at least in part, the opposite ends of the sleeve. The one panel includes a handle strap by which the canon can be carried. The handle strap is disposed in a stowed substantially coplanar relationship with the one panel when the carton subsists as an open-ended sleeve and is automatically put into a position of use when the end closure panels are hinged into their closed positions so that at least a user portion of the handle panel stands proud of the one panel.

16 Claims, 6 Drawing Sheets

FIG. 6
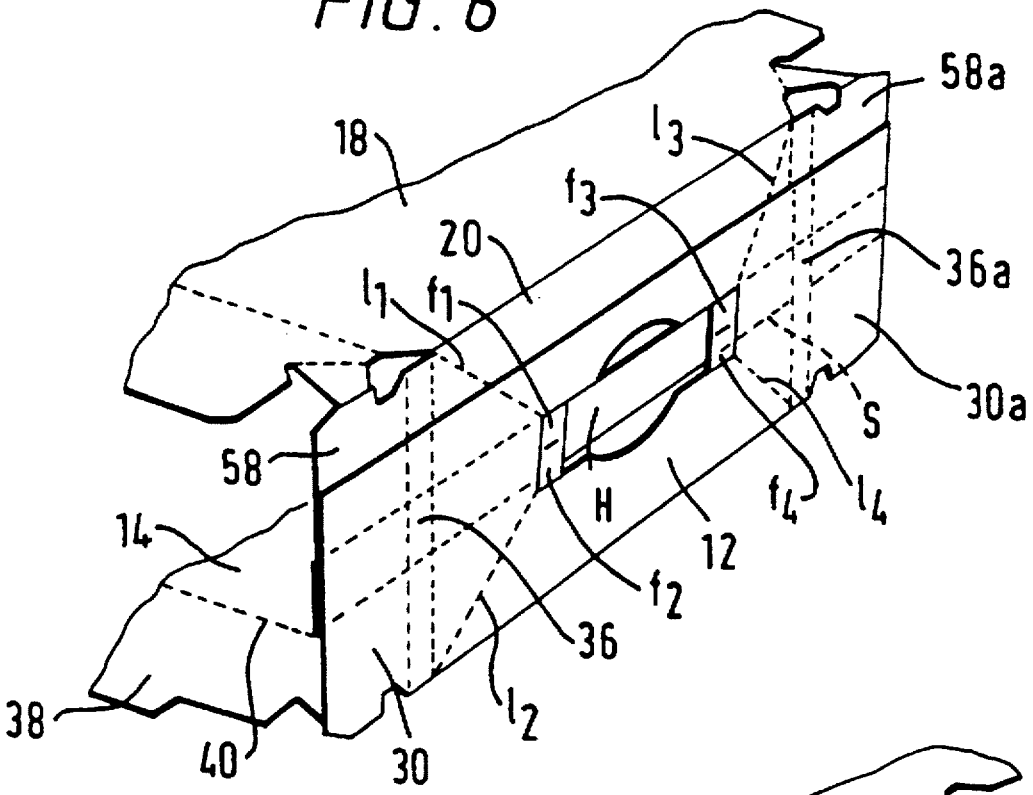
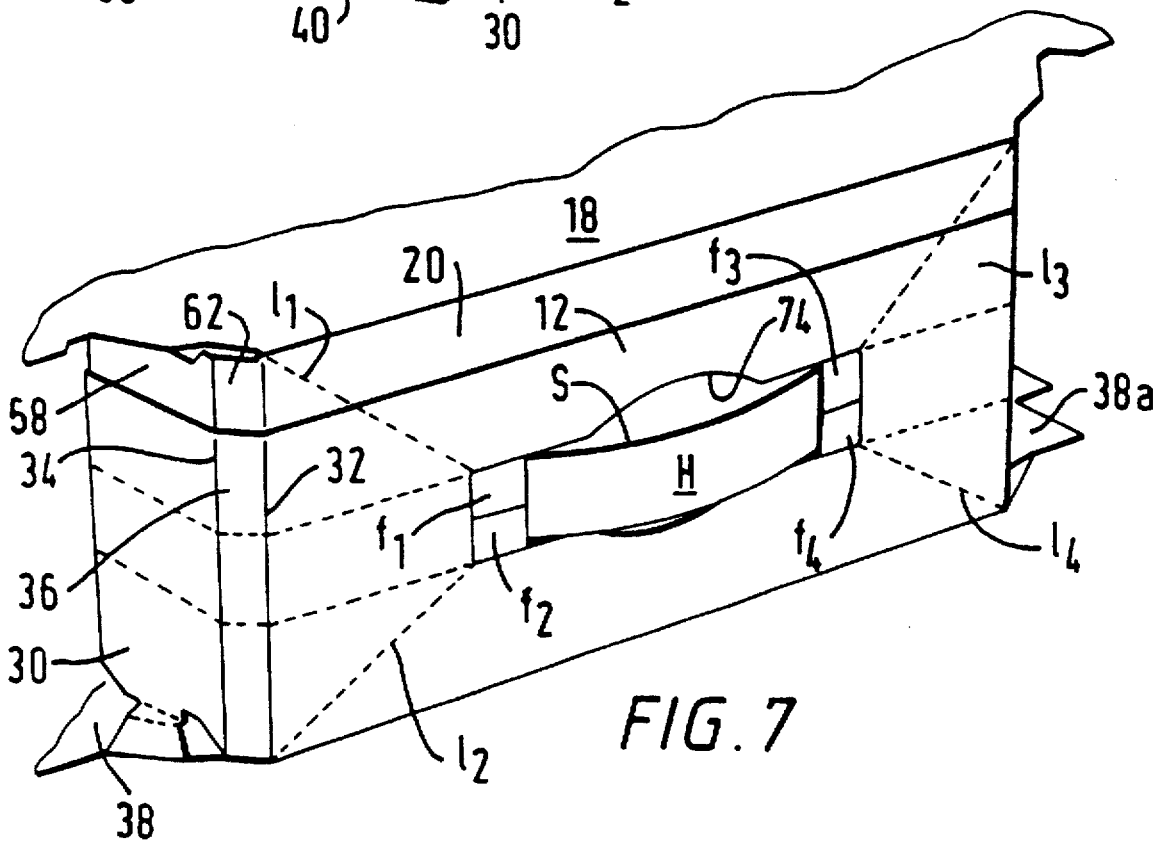
FIG. 7

CARTON FOR BEVERAGE CONTAINERS WITH STRAP TYPE CARRYING HANDLE

BACKGROUND OF THE INVENTION

This invention relates to a carton which is particularly but not only suitable for accommodating beverage containers such as cans and which incorporates a "strap-type" carrying handle which preferably is automatically set up into a position of use as the carton is being closed after having been loaded.

Beverage cartons which include carrying handles and, indeed, strap type carrying handles are known. U.S. Pat. No. 2,889,104 (Caster) discloses a carton having an integral strap handle and a handle slot. The strap handle is formed from an inner top lap panel whereas the handle slot is formed in the outer top lap panel. A pair of end flaps is foldably joined to the opposite end edges of the inner lap panel to form parts of the carton end walls. The handle strap itself is relatively short and is formed solely from one of the main panels of the carton.

U.S. Pat. No. 4,378,905 discloses a carton having a two-ply strap handle formed from the top lap panel of the carton. A score line is formed in the top lap panel and extends into both the end flaps associated with the top lap panel. A portion between the score line and the adjacent free side edge of the carton is folded double to form the handle joined at its opposite ends to the carton end walls. The strap handle extends completely across the top wall and load is transmitted from the handle into the end walls of the carton.

U.S. Pat. No. 2,955,739 shows an integral strap handle similar to U.S. Pat. No. 4,378,905 wherein a relatively wide slot is provided instead of a score line to define the strap handle.

European Patent No. 0 098 903 shows a handle slot having a pair of end tabs for partially covering a portion of the handle exposed in the slot. The handle strap itself is formed wholly from one of the end closure panels at one end of the carton.

German Patent DE 2 052 618 shows a strap handle formed from the top wall of a wrap-around carton and having opposite ends thereof extending into the carton side walls. The handle has no fold line co-linear with the fold lines between the top wall and the adjacent side walls and thus allows itself to "pop-up" when the side walls are folded downwardly.

SUMMARY OF THE INVENTION

In the present invention in one of its various aspects, a "pop-up" strap carrying handle is provided in a top wall of the carton so that a central part of the strap is exposed to view in a handle access aperture. Intermediate and end portions of the handle strap are disposed internally of the carton, and the end portions are joined to each of the end closure panels which are hinged to the top wall. When the carton is lifted by the exposed part of the handle strap, load is transmitted from the handle strap to the top wall of the carton at each of the opposite ends of the handle access aperture and is distributed through the top wall.

One aspect of the present invention provides a carton for beverage containers which carton includes a series of hinged panels forming a sleeve and end closure panels hinged at least to one of the hinged panels for closing, at least in part, the opposite ends of the sleeve, wherein the one hinged panel includes a handle strap by which the carton can be carried, the handle strap being disposed in a stowed substantially coplanar relationship with the one hinged panel when the carton subsists as an open-ended sleeve and being put into a position of use when the end closure panels are hinged into their closed positions whereby at least a portion of the handle strap stands proud of the one panel.

According to a feature of this aspect of the invention, parts of the handle strap other than the proud portion may be disposed internally of the carton. The opposite ends of the handle strap may be joined respectively to the end closure panels and the proud portion of the strap may be exposed to view within a handle access aperture provided in another one of the hinged panels.

Another aspect of the present invention provides a carton for beverage containers which carton has a handle strap by which the carton can be carried. The handle strap may be integral with the carton and includes a central user portion exposed to view in a handle access aperture in the top wall of the carton, intermediate portions adjacent to the central user portion and disposed beneath the top wall, and end portions adjacent to the intermediate portions and joined to end closure panels which are hinged to the opposed ends of the top wall and wherein the handle strap may be formed from material provided at one end of a blank from which the carton is formed.

According to a feature of this aspect of the invention the intermediate and end portions may be disposed internally of the carton.

According to yet another feature of this aspect of the invention the user portion may lie substantially coplanar with the top wall when the end closure panels also lie substantially coplanar with the top wall but automatically is deployed through the handle access aperture into a position of use, upstanding from the top wall, when the end closure panels are closed.

Yet another aspect of the invention provides a carton for beverage containers which carton includes a carrying handle strap in contact at spaced locations thereof with a first top panel of the carton and internally thereof. The handle strap includes a user portion exposed to view within a handle access aperture in the first top panel having parts at opposite ends of the user portion, which parts are displaceable out of the plane of the first top panel when the carton is lifted by the handle strap so that load is transmitted from the handle to the first top panel.

According to a feature of this aspect of the invention, the displaceable parts may be hinged flap portions of the first top panel located at the opposed ends of the handle access aperture. Preferably a portion of the handle strap intermediate the spaced locations is disposed in its position of use within the handle access aperture. Preferably, the user portion of the handle strap stands proud of the plane of the first top panel.

According to another feature of this aspect of the invention the handle strap may be formed from the material which is integral with a second top panel which forms a composite top wall of the carton in cooperation with the first top panel.

According to yet another feature of this aspect of the invention the opposite ends of the carton may include end closure panels hinged to a second top panel and wherein the handle strap includes end portions joined to the end closure panels. Preferably, the handle strap is a multi-ply strap formed from the material which is integral with the second top panel and the end closure panels.

According to a still further feature of this aspect of the invention, stress relief scores or fold lines may be provided in the first top panel and extend from the handle access aperture to each corner of the first top panel.

A still further aspect of the invention provides a carton blank comprising a series of main panels hinged one to the next for forming an open ended sleeve and a series of end closure panels hinged along opposed edges of the main panels to close the ends of the sleeve and wherein the material to form a handle strap is an integral part of one end of the blank. The handle strap includes a central portion formed and separated from one of the main panels and end portions joined to the opposed end closure panels hinged to the one main panel.

According to a feature of this further aspect of the invention, the one main panel may be adapted to be secured in a flat face contacting relation to a main panel at the opposite end of the blank. The opposite main panel may be formed with a handle access aperture with which the central portion is brought into register when the one and the opposite main panels are secured together.

BRIEF DESCRIPTION OF THE DRAWING

In the drawings,

FIG. 6 is a perspective view of the top wall of the carton with the end panels of the carton open whereby the carrying handle strap is disposed in a stowed position;

FIG. 7 is a further perspective view of the top wall of the carton showing the end panels associated with the top wall folded into a closed position thereby putting the carrying handle strap into a position for use.

DETAILED DESCRIPTION OF THE PREFERRED EMBODIMENT

Figure 1:
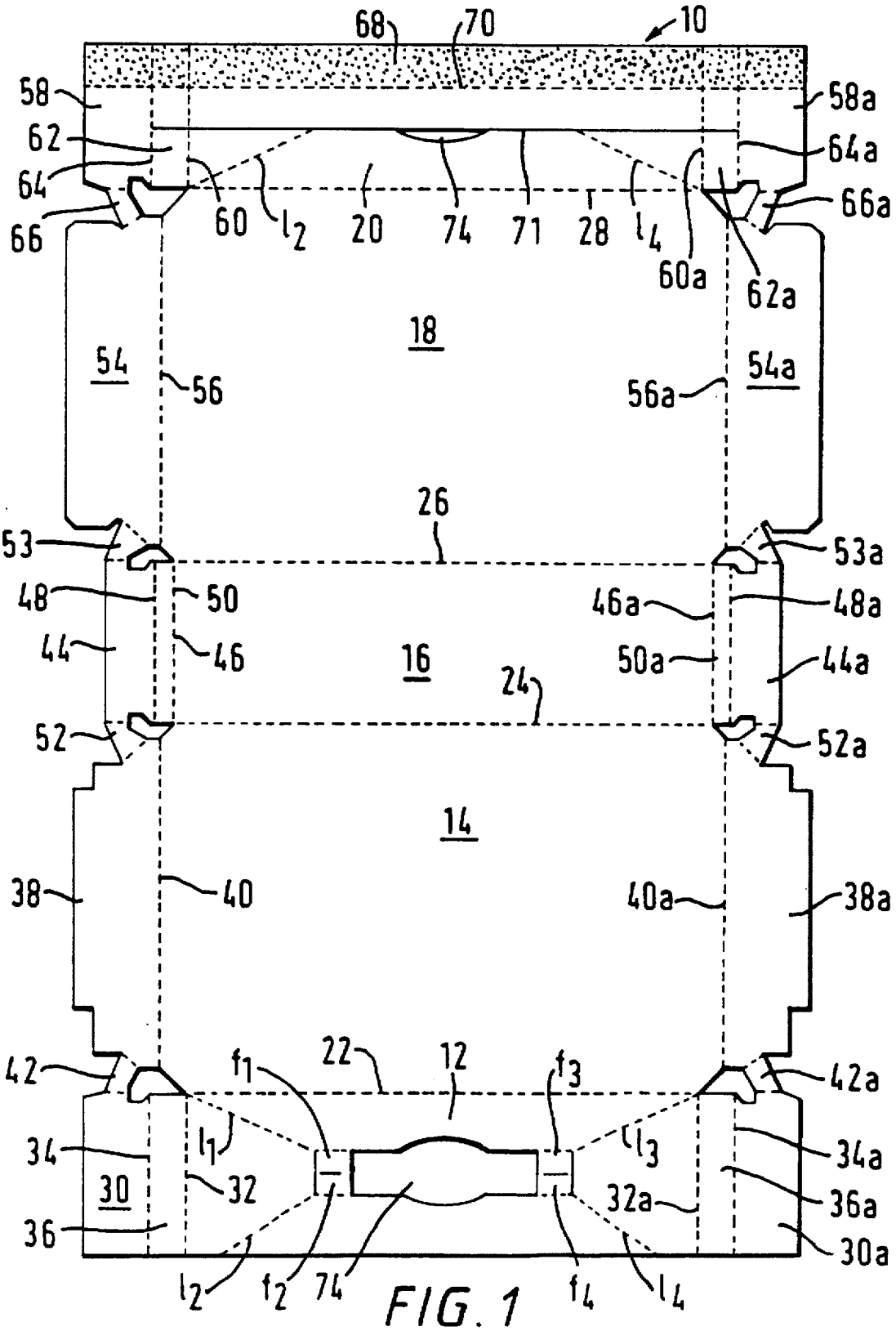
FIG. 1 is a plan view of a carton blank from which a carton according to the invention is formed.

Referring to the drawings, an elongate carton blank 10 formed from paperboard or other suitable foldable sheet material comprises a series of main panels hinged one to the next. The main panels comprise, in series, a first top panel 12, a first side wall panel 14, a base panel 16, a second side wall panel 18, and a second top panel 20 hinged one to the next along transverse fold lines 22, 24, 26 and 28, respectively. The first and second top panels 12 and 20 together form a single composite top wall in the completed carton when they are secured together in overlapping relationship.

In order to close the ends of the carton, a series of end closure panels are hinged along the opposed longitudinal edges of the main panels. Since the carton blank is symmetrical about its longitudinal center line, reference is now made to one set of end closure panels, it being understood that the opposite set of end closure panels are identical and designated by like reference numerals with the addition of the suffix 'a'. Thus, a top end closure panel 30 is hinged to the top panel 12 along a longitudinal hinge line 32. A further hinge line 34 spaced from and parallel to the hinge line 32 is formed in the top end closure panel 30 to provide a so called 'bevelled' corner panel 36, as is best seen, for example, in FIG. 7 and 8 of the drawings. A side wall end closure panel 38 is hinged to the first side wall panel 14 along a longitudinal fold line 40. The top end closure panel 30 and the side wall end closure panel 38 are hinged together by means of a web 42. A bottom end closure panel 44 is hinged to the bottom panel 16 along a longitudinal fold line 46 and a further bevelled panel 50 is created by the provision of a further longitudinal fold line 48 disposed in the end closure panel 44 spaced outwardly of and parallel to the fold line 46.

The bottom end closure panel 44 is hinged to the side end closure panel 38 by means of a mutually hinged web 52. A further side wall end closure panel 54 is hinged to the second side panel 18 along longitudinal fold line 56. The side wall end closure panel 54 is hinged to the bottom end closure panel 44 by a web 53. An end closure panel 58 is hinged to the second top panel 20 along a longitudinal fold line 60. A corner bevelled panel 62 is created by virtue of the provision of a further longitudinal fold line 64 formed in the top end closure panel 58 spaced outwardly of and parallel to the fold line 60. Top end closure panel 58 is hinged to the side end closure panel 54 by means of a mutually hinged web 66. A similar set of end closure panels and webs are provided at the opposite ends of the various main panels.

Figure 2:
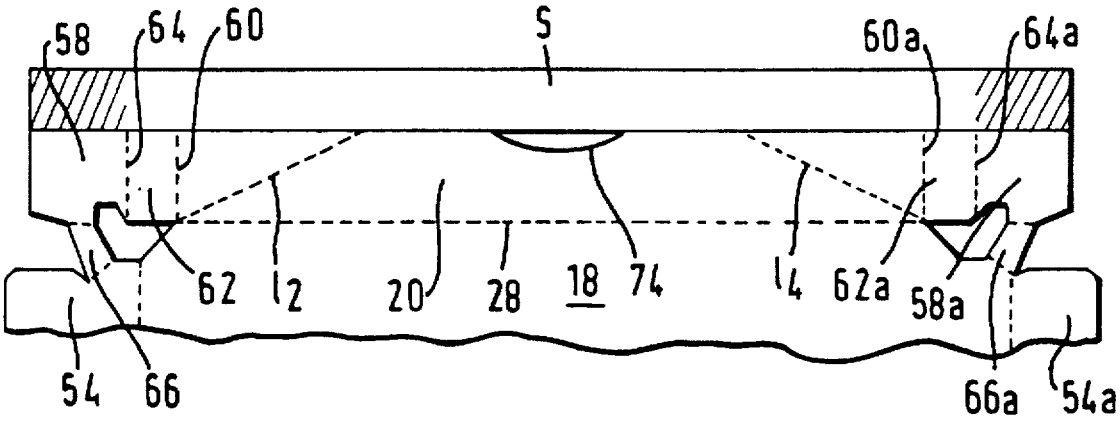
FIG. 2 is a plan view of one end of the blank showing a double ply carrying handle strap.

At one extreme end of the blank, integral with end closure panels 58 and **58*a*, there is provided a handle panel 68 which is provided with a central fold line 70 extending into each of the top end closure panels 58 and 58*a*. Handle panel 68 is separated from top wall panel 20 by transverse slit 71. Thus, glue is applied to the extreme end of the blank as indicated by the stippling in FIG. 1, and then as best seen in FIG. 2, the handle panel 68 is folded double about fold line 70 to produce a two-ply handle strap S which is free of the second top panel 20 but joined at its opposite ends respectively with the end closure panels 58 and 58*a***.

At the opposite end of the blank, the first top panel 12 is formed with a handle access aperture 74, the opposite ends of which are provided with hinged flaps f1, f2 and f3, f4 which are connected to the top panel 12 by means of perforate but frangible fold lines. A set of stress relieving score lines $1_1$–$1_4$ extend from each of the corners of the handle access opening to the adjacent corners of the top panel 12. However, since the top wall of the carton as a whole is in part provided by the second top panel 20, a portion of the handle access opening and stress relief score lines are formed also in the second top panel 20. These are brought into registry with their complementary features in the first top panel 12 when the first and second top panels 12 and 20 are secured together. In a modified arrangement it is envisaged that a single hinged flap is provided at each end of the handle access aperture.

Figure 4:
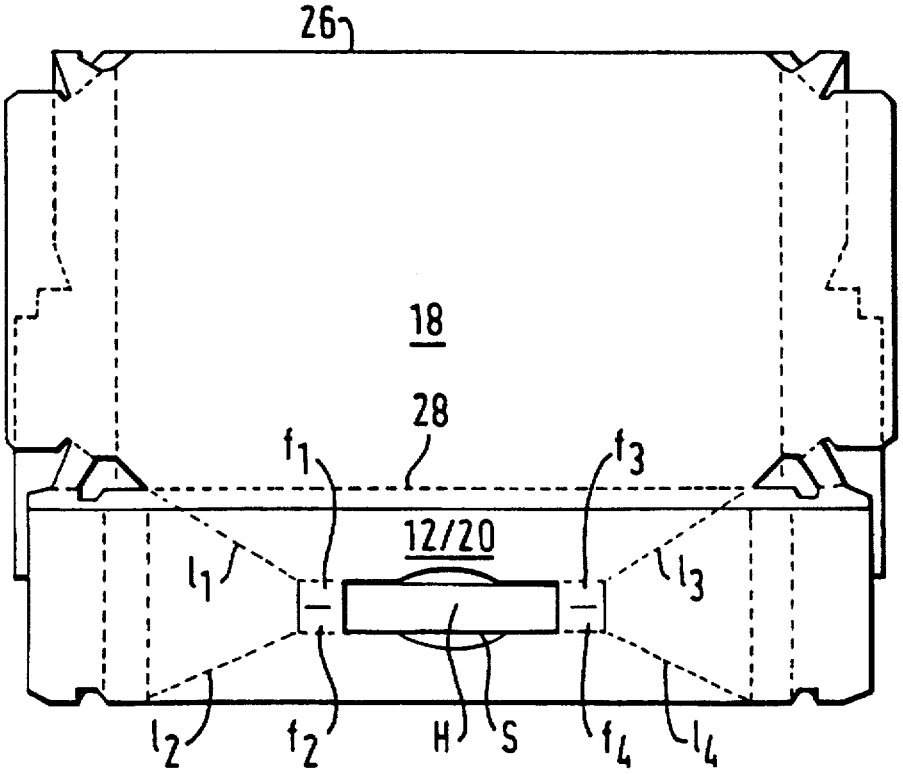
FIG. 4 shows the completed collapsed carton sleeve in a form in which it is supplied to a customer thereafter to be set up and loaded.
Figure 3:
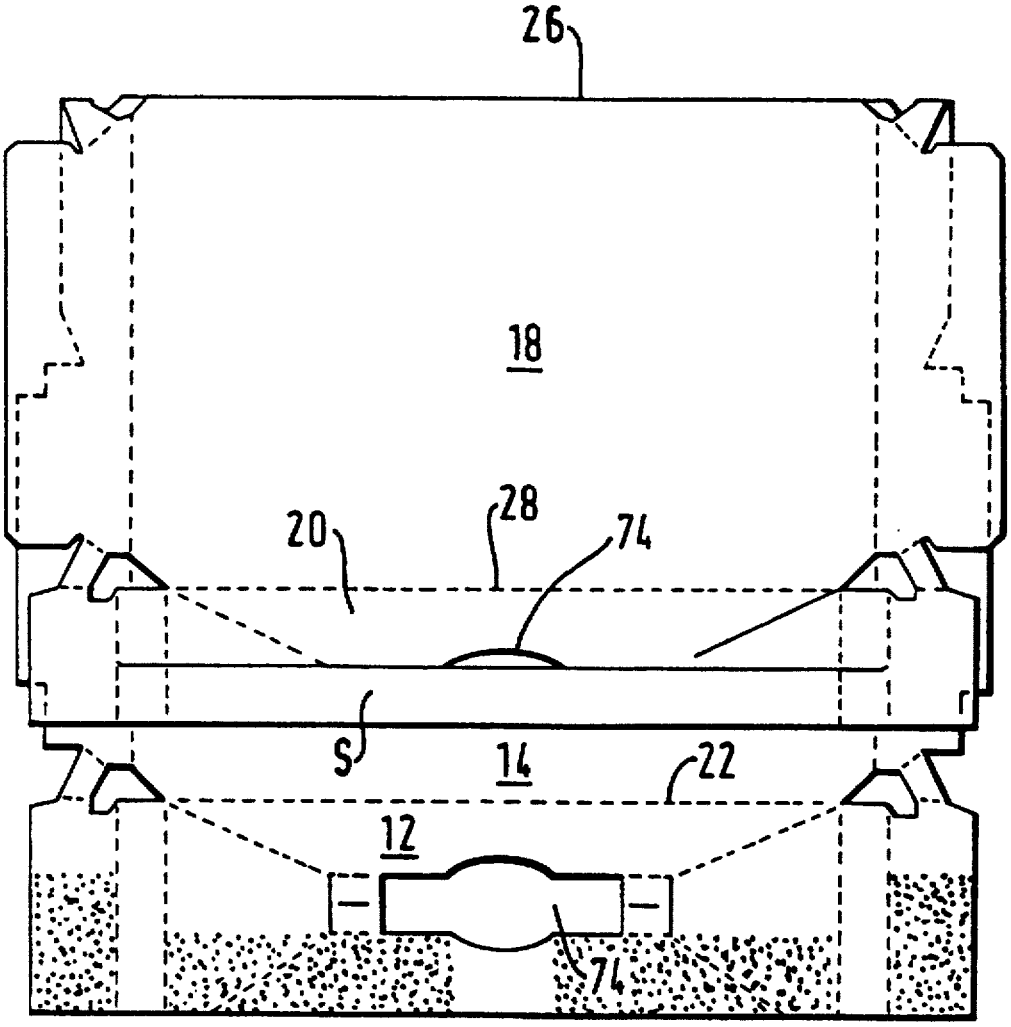
FIG. 3 is a plan view of a blank folded upon itself during formation of the carton in collapsed form.

In order to create a sleeve in flat folded condition from the blank, after the handle panel 68 has been put into its two-ply form S, the blank is folded about fold line 26 so that the side wall panel 18, the second top wall panel 20 together with the double-ply handle strap S are folded together through 180° and brought into face to face contacting relationship with the bottom panel 16 and the first side wall panel 14 as shown in FIG. 3. Thereafter, in order to complete the sleeve, glue is applied to the first top panel 12 as indicated by the stippling in FIG. 3, and then the first top panel 12 is folded through 180° about the fold line 22. By this means, the first top panel 12 is secured in face to face contacting relationship and in registry with the second top panel 20 to provide a complete sleeve in flat collapsed condition, as shown in FIG. 4 of the drawings. It will be readily recognized that glue may be applied to the second top panel 20 instead of the first top panel 12.

Figure 5:
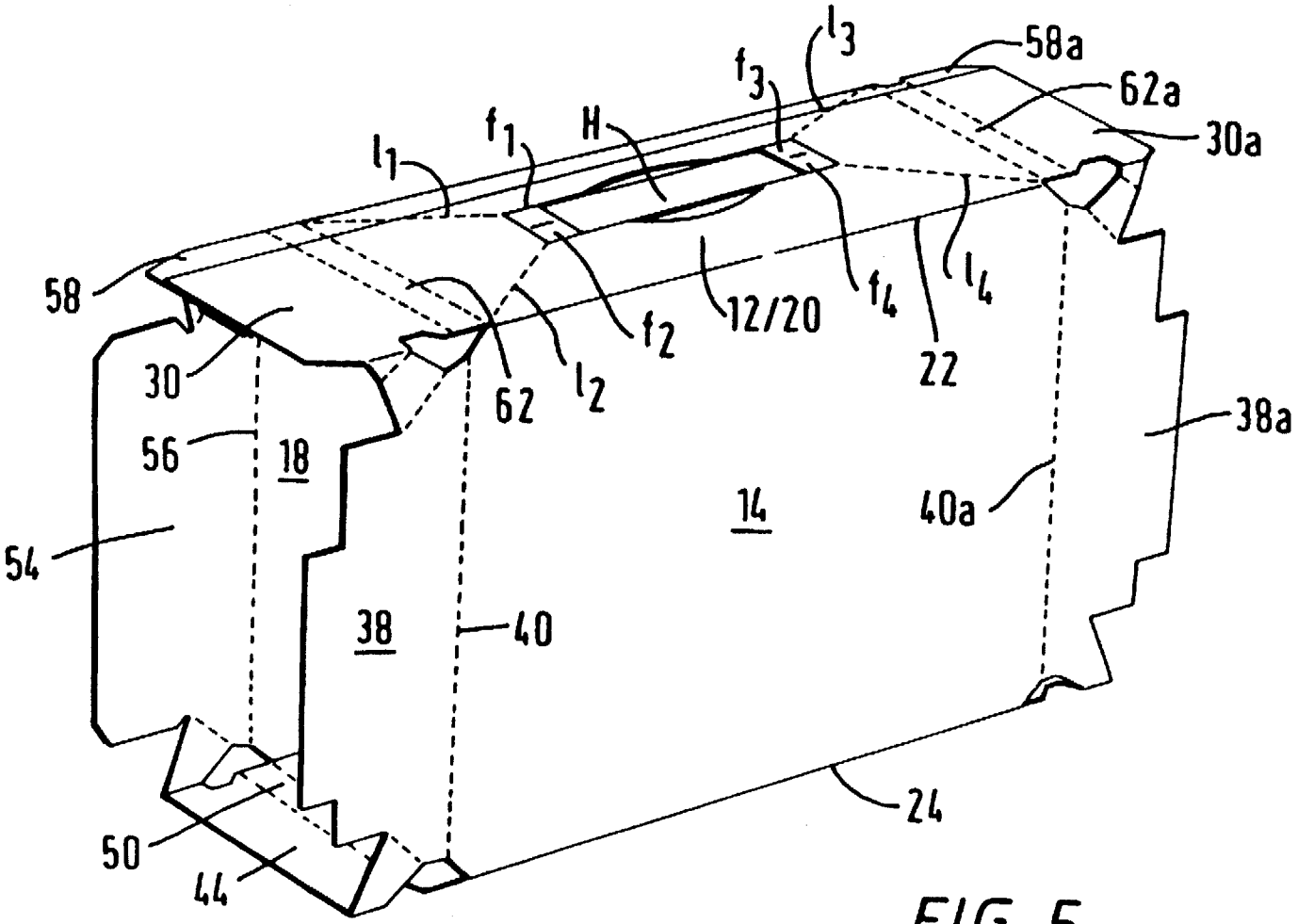
FIG. 5 is a perspective view of the carton sleeve put into a set up condition ready for loading from either or both its open ends.

As can be seen in FIG. 5, the handle strap S has a user portion H exposed to view in the handle access aperture 74 but is otherwise disposed internally of the carton. The handle strap S as a whole is generally coplanar with the composite top wall 12, 20 and with the associated end closure panels 58 and 58*a*.

The carton can then be set up from the flat collapsed condition shown in FIG. 4 to the erected position shown in FIG. 5 ready for loading through each or both of its open ends. Once loading has taken place, the end closure panels are closed and secured together at each of the ends of the carton as is well known in the art.

The end closure panel closing has an effect on the disposition of the handle strap S. When the top panels 12 and 20 are brought into registry with each other, it will be seen by reference to FIG. 6 that the central user part H of the handle strap S is exposed to view in the handle access aperture 74. While the top end closure panels 58, 58*a*, 30 and 30*a* are generally in the plane of the composite top wall 12/20, the handle strap S also remains generally coplanar with the top wall. However, as best shown in FIG. 7 of the drawings, as the top end closure panels are folded into their closing positions, the tautness of the handle strap S across the composite top wall is reduced so that in effect the handle strap S which is free of restraint of the top panels 12 and 20 becomes slack and the central user part H of the handle strap S bows upwardly and protrudes through the handle access aperture 74 as shown in FIG. 7. Thus the central part H of the handle strap S is bowed upwardly proud of the top wall into a position for ready use. To encourage bowing of the central part H, the fold lines 60 and 60*a* may be omitted from the handle panel 68.

Figure 8:
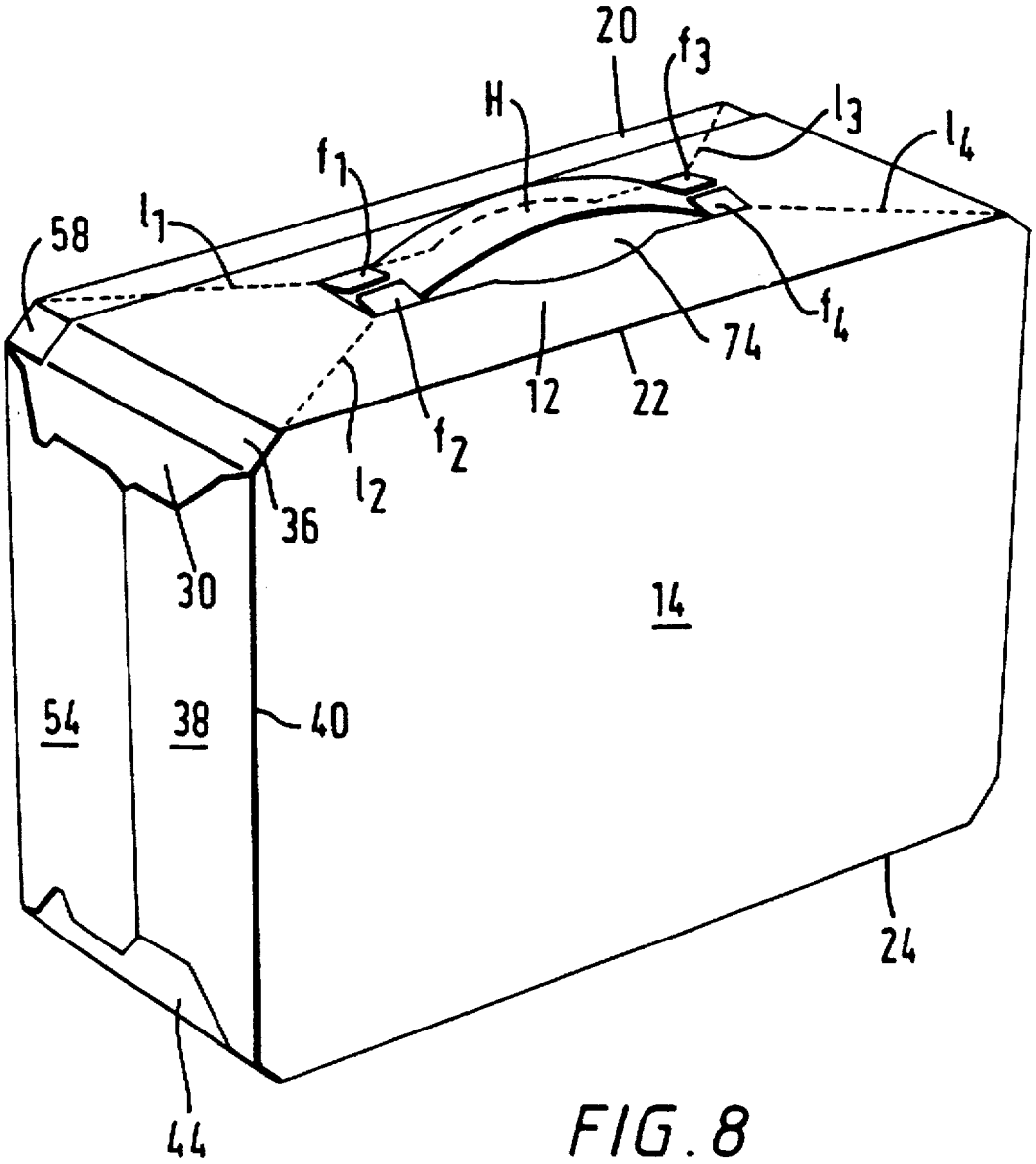
FIG. 8 is a perspective view of the completed carton with the carrying handle disposed in a position of use upstanding from an aperture in the top wall of the carton.

FIG. 8 shows the completed carton as it would be presented to a user.

Thus in order to lift the carton, a user would grasp the handle strap S whereby upward force on the handle strap S causes the frangible parts of the hinged flaps f1–f4 at opposite ends of the handle access aperture 74 to break so that load exerted by the carton on the handle strap is transmitted at the ends of the handle access aperture to the carton top wall. The stress distribution score lines allow the top wall of the carton to "give" somewhat so that the stresses transferred to the carton panels are more evenly distributed whereby that tearing is inhibited.

I claim:

1. A carton comprising:

a plurality of main panels hinged together to form a sleeve having opposite end openings, one of said main panels having a handle access aperture formed therein;

a pair of end closure panels for closing at least in part said opposite end openings respectively, said end closure panels being hinged to said one main panel along a pair of opposed fold lines respectively so that said end closure panels are movable between an opened position where said end closure panels are coplanar with said one main panel and a closed position where said end closure panels close said opposite end openings at least in part; and a handle strap having opposite extreme ends secured respectively to said end closure panels such that when said end closure panels are in said opened position, said handle strap is flat and includes a central user portion exposed to view within said handle access aperture and the other portions in face to face contacting relationship with respective inside surfaces of said one main panel and said end closure panels, whereby said handle strap becomes slack and protrudes externally through said handle access aperture when said end closure panels are brought into said closed position.

2. The carton according to claim 1, wherein said handle strap is free of restraint of said one main panel.

3. The carton according to claim 2, wherein said handle access aperture has opposite ends spaced from said fold lines.

4. The carton according to claim 3, wherein said other portions of said handle strap are disposed internally of said carton such that said other portions are hidden from view by said one main panel and said end closure panels.

5. A carton comprising:

a plurality of carton walls hinged together to form a sleeve having opposite end openings, one of said carton walls comprising a pair of inner and outer panels secured together in face to face contacting relationship, said outer panel having a handle access aperture formed therein;

a pair of end closure walls for closing at least in part said opposite end openings respectively, each of said end closure walls comprising inner and outer end flaps secured together in face to face contacting relationship, said inner end flaps being hinged respectively to said inner panel along a pair of opposed first fold lines, said outer end flaps being hinged respectively to said outer panel along a pair of opposed second fold lines, said first fold lines being disposed in registry with said second fold lines respectively when said carton subsists as an open-ended sleeve; and a handle strap for use in carrying said carton, said handle strap including a medial portion and opposite end portions, said medial portion being formed from said inner panel so that when said carton subsists as said open-ended sleeve, said medial portion is disposed in part covered by said outer panel and in part in said handle access aperture, said opposite end portions being formed respectively from said inner end flaps so that when said carton subsists as said open-ended sleeve, said opposite end portions are coplanar with said medial portion and covered respectively by said outer end flaps, said handle strap being connected to the other part of said carton through opposite extreme ends of said handle strap such that said handle strap is free of restraint of said inner and outer panels.

6. The carton according to claim 5, wherein said opposite end portions of said handle strap are separated from said outer end flaps.

7. The carton according to claim 5, wherein said handle strap is separated from said inner panel by a slit disposed entirely across said inner panel, said slit extending astride each of said first fold lines into said inner end flaps.

8. The carton according to claim 7, wherein each of said inner end flaps is provided with a third fold line disposed parallel to an adjacent one of said first fold lines, and said slit terminates on said third fold lines.

9. The carton according to claim 8, wherein each of said outer end flaps is provided with a fourth fold line disposed parallel to an adjacent one of said second fold lines, and said fourth fold lines being disposed in general registry with said third fold lines respectively when said carton subsists as an open-ended sleeve.

10. The carton according to claim 5, said first fold lines terminate at said slit so that said handle strap is devoid of said first fold lines.

11. The carton according to claim 5, wherein said handle strap is a multi-ply strap formed of a plurality of layers of material secured together in face to face contacting relationship.

12. The carton according to claim 5, wherein said carton is formed from a single sheet material.

13. The carton according to claim 5, wherein said carton is formed from an elongate blank comprising said inner panel located at an end of said blank, said inner panel having a slit extending entirely across said inner panel to provide said handle strap located at an extreme end of said blank.

14. The carton according to claim 13, wherein said slit extends into said inner end flaps.

15. The carton according to claim 13, wherein said handle strap is formed from a handle panel at said extreme end, said handle panel being provided with a central fold line so as to be folded double about said central fold line to produce said handle strap of a two-ply structure.

16. The carton according to claim 15, wherein said two-ply structure comprises two layers of material secured together in face to face contacting relationship.

* * * * *